US006768108B2

(12) United States Patent
Hirano et al.

(10) Patent No.: US 6,768,108 B2
(45) Date of Patent: Jul. 27, 2004

(54) ION ATTACHMENT MASS SPECTROMETRY APPARATUS, IONIZATION APPARATUS, AND IONIZATION METHOD

(75) Inventors: Yoshiki Hirano, Tokyo (JP); Yoshiro Shiokawa, Tokyo (JP); Toshihiro Fujii, Tokyo (JP); Munetaka Nakata, Tokyo (JP); Masao Takayanagi, Tokyo (JP)

(73) Assignee: Anelva Corporation, Fuchu (JP)

( * ) Notice: Subject to any disclaimer, the term of this patent is extended or adjusted under 35 U.S.C. 154(b) by 0 days.

(21) Appl. No.: 10/610,809

(22) Filed: Jul. 2, 2003

(65) Prior Publication Data

US 2004/0011955 A1 Jan. 22, 2004

(30) Foreign Application Priority Data

Jul. 2, 2002 (JP) ..... 2002-193665

(51) Int. Cl.[7] ..... H01J 49/00
(52) U.S. Cl. ..... 250/288; 250/423 R; 250/424
(58) Field of Search ..... 250/288, 423 R, 250/424

(56) References Cited

U.S. PATENT DOCUMENTS 5,543,615 A * 8/1996 Saito et al. ..... 250/251

FOREIGN PATENT DOCUMENTS

JP 06-011485 1/1994

OTHER PUBLICATIONS

R.V. Hodges et al., "Application of Alkali Ions in Chemical Ionization Mass Spectrometry", Analytical Chemistry, May 1976, vol. 48, No. 6, pp. 825–829.

Daniel Bombick et al., "Potassium Ion Chemical Ionization and Other Uses of an Alkali Thermionic Emitter in Mass Spectrometry", Analytical Chemistry, 1984, vol. 56, No. 3, pp. 396–402.

Toshihiro Fujii et al., "Chemical Ionization Mass Spectrometry with Lithium Ion Attachment to the Molecule", Analytical Chemistry, 1989, vol. 61, No. 9, pp. 1026–1029.

Toshihiro Fujii, "A Novel Method for Detection of Radical Species in the Gas Phase: Use of Li+ Ion Attachment to Chemical Species", Chemical Physics Letters, Mar. 27, 1992, vol. 191, No. 1,2 pp. 162–168.

* cited by examiner

*Primary Examiner*—Kiet T. Nguyen
(74) *Attorney, Agent, or Firm*—Burns, Doane, Swecker & Mathis, L.L.P.

(57) ABSTRACT

An ion attachment mass spectrometry apparatus provided with a first chamber and a second chamber separated by a partition having an aperture (nozzle), an emitter, a mass spectrometer, a vacuum pump, and a sample gas introduction mechanism for introducing a sample gas and making metal ions attach to sample gas molecules to make the sample gas positive ions. Further, the Knudsen number of the aperture is made not more than 0.01, the pressure of the second chamber is not more than 1/10th of the first chamber, gas of the sample gas in the first chamber is blown out from the aperture to the second chamber, and a supersonic jet formed in the second chamber is provided. Sample gas and metal ions are injected into the supersonic jet region and metal ions are made to attach to the sample gas molecules.

8 Claims, 9 Drawing Sheets

ION ATTACHMENT MASS SPECTROMETRY APPARATUS, IONIZATION APPARATUS, AND IONIZATION METHOD

This application claims priority under 35 U.S.C. §§119 and/or 365 to JP2002-193665 filed in Japan on July 2, 2002; the entire content of which is hereby incorporated by reference.

BACKGROUND OF THE INVENTION

1. Field of the Invention

The present invention relates to an ion attachment mass spectrometry apparatus, ionization apparatus, and ionization method, more specifically relates to an apparatus able to analyze the mass of a sample gas at a high sensitivity without causing disassociation of molecules of the sample gas and an ionization apparatus and ionization method suitable for that apparatus.

2. Description of the Related Art

A mass spectrometry apparatus for measuring the molecular weight of a sample gas passes an ionized sample gas through an electromagnetic field (one or both of an electric field and magnetic field) to separate it by mass and detect the weight. The electron impact method, the most general of the ionization methods, causes electrons to strike the sample gas at a high energy of about 70 eV and uses the impact energy to strip electrons from the molecules of the sample gas to obtain positive ions. However, according to the electron impact method, there was the problem that the molecules of the sample themselves are split (disassociated) by the high impact energy and therefore correct measurement was not possible.

Therefore, the ion attachment method has been developed as a method for ionization of molecules of a sample gas without causing disassociation. This ion attachment method has been reported in Hodges, *Analytical Chemistry*, vol. 48, no. 6, p. 825 (1976); Bombick, *Analytical Chemistry*, vol. 56, no. 3, p. 396 (1984); Fujii et al., *Analytical Chemistry*, vol. 61, no. 9, p. 1026 (1989), *Chemical Physics Letters*, vol. 191, no. 1.2, p. 162 (1992), Japanese Unexamined Patent Publication (Kokai) No. 6-11485, and Japanese Examined Patent Publication (Kokoku) No. 7-48371.

In the ion attachment method, first, an emitter including a metal salt of Li, Na, Al, etc. is heated to cause the generation of metal ions such as $Li^+$, $Na^+$, and $Al^+$. Next, the metal ions are brought into contact with the sample molecules, whereupon the metal ions attach to locations where the charges of the sample molecules concentrate and the sample molecules as a whole become ions (hereinafter called "attached ions or pseudo-molecule ions"). The energy of attachment of the metal ions to the sample molecules, that is, binding energy, is an extremely small one of about 1 eV. This is smaller than the normal binding energy of compounds of 2 to 3 eV, so the molecules will not easily disassociate even after attachment.

However, if the surplus energy remains in the above attached ions, the metal ions with the surplus energy will disassociate and in turn the sample gas will return to its original neutral molecules. Therefore, by making the attached ions and atmospheric gas collide, the surplus energy is quickly removed and stable attached ions are obtained. The atmospheric gas may be the sample gas itself or a gas other than the sample gas, but a pressure of about 100 Pa is required. If below 100 Pa, the number of frequency of collisions is small and surplus energy cannot be sufficiently removed.

A mass spectrometry apparatus using the ion attachment method is called an "ion attachment mass spectrometry apparatus". The overall configuration of a conventional ion attachment mass spectrometry apparatus is shown in FIG. 17. As shown in this figure, an ion attachment mass spectrometry apparatus is usually comprised of a first chamber 102 provided with an emitter 101 for emitting ions, a second chamber 103 comprising an intermediate chamber, and a third chamber 105 provided with a mass spectrometer 104 for mass spectrometry. The first chamber 102 and second chamber 103 are provided between them with a partition 107 having an aperture 106 of a diameter of about 1 mm is provided between the first chamber 102 and the second chamber 103. The aperture 106 is normally given by a nozzle structure. An aperture 108 is provided between the second chamber 103 and third chamber 105. By evacuation by a vacuum pump, the first chamber 102 is reduced to pressure of 100 Pa, the second chamber 103 to 0.1 Pa, and the third chamber 105 to $10^{-3}$ Pa or so. Note that the gas 109 introduced into the first chamber 102 may be comprised of the sample alone or may be comprised of mixed gas comprising a base gas such as an inert gas and sample gas. In FIG. 17, details of the configuration of the emitter 101 are omitted.

On the other hand, for an object different from that of an ion attachment mass spectrometry apparatus, there are an inductively coupled plasma (ICP) mass spectrometry apparatus and atmospheric pressure ionization (API) mass spectrometry apparatus, which can measure a sample gas at an extremely high sensitivity. These mass spectrometry apparatuses are provided with first chambers, second chambers, and third chambers similar to those explained above. In both cases, the pressure of the first chamber for ionization is made $1\times10^5$ Pa (atmospheric pressure), the pressure of the second chamber is made 10 to 1000 Pa, and the pressure of the third chamber for mass spectrometry is made $10^{-3}$ Pa or so.

As a means for ionization, an inductively coupled plasma mass spectrometry apparatus uses plasma, while an atmospheric pressure ionization mass spectrometry apparatus uses a corona discharge. In both cases, the electrons generated are made to collide with the sample gas by an energy of several tens of eV to strip off electrons from the sample molecules and obtain positive ions, then ion exchange or another ionization reaction is caused in a chain to realize highly efficient ionization.

In general, when the pressure is high, the number of collision frequency increases, the chain reaction proceeds faster, and the plasma spreads the ionization reaction by itself (self expansion action), so low ion mobility due to the high pressure does not become a problem. Therefore, in all of the above conventional mass spectrometry apparatuses, the optimal pressure of the first chamber is the atmospheric pressure. Normally, a nozzle having an aperture of a diameter of about 1 mm is provided between the first chamber and the second chamber. Since the first chamber is a high pressure, the gas blown out from the nozzle forms a supersonic jet. This supersonic jet causes the ionized sample to be efficiently transported to the mass spectrometer.

In the ordinary vacuum state, a gas spreads uniformly randomly. The translation energy (speed) of this movement is a thermal motion energy at room temperature, so is 0.03 eV or so. As opposed to this, the supersonic jet is extremely characteristic and is comprised of an "expansion part", a "silent part", a "Mach disk", and a "barrel shock" (see FIG. 2).

The "expansion part" is the part forming a peak of pressure higher than the surroundings near the nozzle outlet. Therefore, the gas or ions collide at a high frequency, a rapid drop in pressure and expansion of gas flow arises, and the gas or ions are cooled by adiabatic expansion. The "silent part" is after the expansion part and forms a bowl of pressure lower than the ambient atmospheric gas. The gas or ions proceed forming beams of uniform direction and speed. This thermal energy also reaches about 3 eV or 100 times as high as the thermal energy at room temperature. Note that an inductively coupled plasma mass spectrometry apparatus and atmospheric pressure ionization mass spectrometry apparatus use this characteristic to raise the transport efficiency of ions. The "Mach disk" is the end of the silent part, while the "barrel shock" is at the side. Both form barriers of pressure higher than the ambient atmospheric gas. The atmospheric gas is blocked by these and cannot penetrate into the silent part.

For the supersonic jet to be formed, it is necessary that the Knudsen number ($\lambda$/D) of the length of mean free path ($\lambda$) of the gas in the first chamber divided by the diameter (D) of the nozzle be less than 0.01 and that the inner pressure of the second chamber is not more than 1/10th of the inner pressure of the first chamber. In particular, if the Knudsen number is not more than 0.001 and the inner pressure of the second chamber is not more than 1/100th of the inner pressure of the first chamber, it is known that a more powerful supersonic jet is formed. An ordinary inductively coupled plasma mass spectrometry apparatus and atmospheric pressure ionization mass spectrometry apparatus satisfy this condition.

Note that with the conventional ion attachment mass spectrometry apparatus explained in FIG. 17, the Knudsen number is about 0.07, so a supersonic jet is not formed.

Note that as an example of use of the characteristic of the "expansion part" of the supersonic jet, the formation of gas clusters is known. Neutral gases are extremely weak in attachment energy with each other, so even if gases collide and temporarily attach to each other, they end up immediately separating due to the surplus energy. Therefore, under ordinary conditions, the gas will never form gas clusters, but in the "expansion part" of a powerful supersonic jet, gas clusters are formed. This is due to two reasons: there are numerous opportunities for attachment since gases collide at a high frequency and surplus energy is quickly removed to cooling by adiabatic expansion.

With a conventional ion attachment mass spectrometry apparatus, there was the problem of a low sensitivity of measurement. Compared with the inductively bonded plasma mass spectrometry apparatus or atmospheric pressure ionization mass spectrometry apparatus, the conventional ion attachment mass spectrometry apparatus has a low sensitivity of $10^{-3}$ to $10^{-5}$. This is because (1) the transport efficiency of metal ions to the attachment region, (2) the attachment efficiency of metal ions to the sample gas, and (3) the transport efficiency of attached ions to the mass spectrometer are not sufficient.

FIG. 18 is a detailed enlarged view of the vicinity of an emitter 101 and aperture 106 in a conventional ion attachment mass spectrometry apparatus. The aperture 106 is formed by a nozzle 110. Reference numeral 111 is a jet flow. The $Li^+$ or other metal ions discharged from the emitter 101 and they are repelled each other by the Coulomb force and spread in the four directions in the first chamber 102. However, due to the parallel electric field in the direction of the nozzle 110 and flow of the gas 109, the region 112 where the metal ions are present becomes spherical somewhat toward the nozzle 110. It is not possible to make the metal ions concentrate at a specific region because the length of mean free path at 100 Pa in the first chamber 102 is an extremely short 70 $\mu$m and even if making the metal ions move in the electric field, they immediately collide with the gas and end up stopping or changing in direction. On the other hand, since the sample gas spreads uniformly in the first chamber 102, attachment occurs everywhere in the spherical region 112 where the metal ions are present. However, the attached ions generated at a part far from the nozzle 110 cannot reach the nozzle 110, so the effectively used attachment region 113 is limited to a smaller region close to the nozzle 110. Therefore, in a conventional ion attachment mass spectrometry apparatus, the transport efficiency of the metal ions to the attachment region pointed out in the above (1) is not so high.

Next, the attachment region of the metal ions is a constant pressure of 100 Pa, so attached ions are produced by the collision of the randomly moving sample gas and metal ions as thermal motion. After this, the surplus energy is removed by the collision of randomly moving atmospheric gas and attached ions as thermal motion. In each case, since the random motion of the gas due to thermal motion at room temperature is due to the motion of gas, the attachment efficiency of metal ions and sample gas pointed out at the above (2) is not so high.

The attached ions passing through the nozzle 110 are transported to the mass spectrometer 104 by the force of the electric field. However, the attachment ions generated from an attachment region of a certain size pass through the nozzle 110, then have different speeds and directions. With just an electric field, it is difficult to converge and transport ions of different speeds and directions at a specific location. Therefore, the transport efficiency of the attached ions to the mass spectrometer pointed out at the above (3) is not high.

Note that if the first chamber 102 is made to have a higher pressure than 100 Pa, the sensitivity falls. This is because the efficiency of removing the surplus energy becomes saturated at a higher pressure than 100 Pa and no longer increase, while the transport efficiency of the attached ions to the mass spectrometer greatly fall.

The efficiencies of the above (1) to (3) are not sufficient, therefore the sensitivity is low. This is the most important problem in an ion attachment spectrometry apparatus.

Furthermore, in a conventional ion attachment mass spectrometry apparatus, the sample gas contacts the emitter 101, whereby products deposit on the surface of the emitter 101 and the amount of emission of metal ions ends up falling. In particular, in the case of a readily reactable sample gas, this becomes a major problem in practical use.

Further, in a conventional ion attachment mass spectrometry apparatus, there is the problem that the pressure of the measured gas has to be made higher than the pressure of the first chamber 101 (100 Pa). This is because it is necessary to make the pressure higher to pull the sample gas into the chamber. In order to apply this apparatus to broader industrial applications, the measurable gas pressure should be as low as possible.

SUMMARY

An object of the present invention is to provide an ion mass spectrometry apparatus improving the transport efficiency of the metal ions to the attachment region, the attachment efficiency of the metal ions and sample gas, and the transport efficiency of the attached ions to the mass spectrometer and raise the measurement sensitivity.

Another object of the present invention is to provide an ionization apparatus and ionization method for attaching metal ions to gas molecules and improving the transport efficiency of the metal ions to the attachment region and the attachment efficiency of the metal ions to sample gas.

The ion attachment mass spectrometry apparatus, ionization apparatus, and ionization method according to embodiments of the present invention are configured as follows to achieve the above objects.

A first ion attachment mass spectrometry apparatus according to a first aspect of the present invention is provided with a first chamber and second chamber separated by a partition having an aperture, an emitter generating positive metal ions, a mass spectrometer, a vacuum pump for reducing the pressure of at least the second chamber, and a sample introduction mechanism for introducing a sample gas. The metal ions are made to attach to the molecules of the sample gas to obtain positive ions and the mass of the sample gas is analyzed by the mass spectrometer. A supersonic jet region is formed in the second chamber by making the Knudsen number ($\lambda/D$, where $\lambda$ is the length of mean free path in the first chamber and D is the diameter of the aperture) not more than 0.01, making the pressure of the second chamber not more than 1/10th of the first chamber, and making the gas of the first chamber be blown out from the aperture to the second chamber. The sample gas and metal ions are injected into the supersonic jet region to make the metal ions attach to the molecules of the sample gas at the supersonic jet region.

A second ion attachment mass spectrometry apparatus preferably has a Knudsen number of not more than 0.001, a pressure in the first chamber of at least $1\times10^5$ Pa, and a second chamber of not more than $1\times10^3$ Pa.

A third ion attachment mass spectrometry apparatus preferably gives a relationship between a pressure of the first chamber of P1, a pressure of the second chamber of P2, and a distance from the aperture to the aperture arranged in front of the mass spectrometer of L where $L<0.67\times D\times(P1/P2)^{0.5}$, whereby the Mach disk of the supersonic jet is positioned behind the aperture.

A fourth ion attachment mass spectrometry apparatus preferably provides an emitter at the first chamber, controls the flow of gas in the first chamber, transports the metal ions generated at the emitter to the vicinity of the aperture inlet of the first chamber, and injects metal ions to the supersonic jet region.

An ionization apparatus according to one embodiment of the present invention is provided with a first chamber and second chamber separated by a partition provided with an aperture, an emitter provided in the first chamber for generating positive metal ions, a vacuum pump for reducing the pressure of at least the second chamber, and a sample introduction mechanism for introducing a neutral gas into the first chamber and causing attachment of metal ions to molecules of sample gas to create positive ions. This ionization apparatus is provided with a supersonic jet region formed in the second chamber by making the Knudsen number ($\lambda/D$, where $\lambda$ is the length of mean free path in the first chamber and D is the diameter of the aperture) not more than 0.01, making the pressure of the second chamber not more than 1/10th of the first chamber, and making the gas of the first chamber be blown out from the aperture to the second chamber. Gas and metal ions are injected into the supersonic jet region and metal ions are made to attach to the gas molecules in the supersonic jet region.

An ionization method according to one embodiment of the present invention is a method for ionization by making metal ions attach to neutral gas molecules. It forms two chambers separated by a partition provided with an aperture, introduces gas to one chamber while evacuating the other chamber, makes the Knudsen number ($\lambda/D$, where $\lambda$ is the length of mean free path in the first chamber and D is the diameter of the aperture) of not more than 0.01, and gives a pressure difference of at least one order of magnitude in terms of the Pa value between the two chambers so as thereby to form a supersonic jet region in the vicinity of the aperture at the other chamber and injection metal ions into the supersonic jet region for ionization.

Note that in the above ion attachment mass spectrometry apparatus, the following configurations may be adopted:

(1) Providing an emitter in the second chamber, controlling the electric field in the second chamber, and transporting the metal ions generated from the emitter to the vicinity of the aperture outlet of the nozzle of the second chamber so as to inject metal ions in the supersonic jet region.

(2) Providing the emitter in a chamber separated from a first chamber and a second chamber and communicated with the inside of the nozzle, controlling the electric field in the chamber, and transporting metal ions generated from the emitter to the inside of the nozzle so as to inject metal ions into the supersonic jet region.

(3) Making all or part of the nozzle an emitter and generating metal ions from all or part of the inside wall forming the nozzle so as to inject metal ions into the supersonic jet region.

(4) Connecting the sample gas introduction mechanism to the first chamber and transporting the sample gas to the vicinity of the nozzle inlet of the first chamber so as to inject the sample gas into the supersonic jet region.

(5) Connecting the base gas introduction mechanism to the first chamber and connecting the sample gas introduction mechanism to the second chamber and transporting the sample gas to the vicinity of the nozzle outlet of the second chamber so as to inject the sample in the supersonic jet region.

(6) Connecting the base gas introduction mechanism to the first chamber, connecting the sample gas introduction mechanism to a chamber separated into a first chamber and second chamber and communicated with the inside of the nozzle, and transporting the sample gas to the inside of the nozzle so as to inject the sample in the supersonic jet region.

(7) Making gas be blown out from the second nozzle to the second chamber and thereby forming a second supersonic jet region of a supersonic speed at the second chamber under the conditions that the tip of the sample introduction mechanism forms a second nozzle, the Knudsen number ($\lambda'/D'$) of the length of mean free path $\lambda'$ of the gas in the vicinity of the inlet of the second nozzle divided by the diameter D' of the second nozzle is not more than 0.01, and the pressure in the second chamber is not more than 1/10th of the pressure at the vicinity of the inlet of the second nozzle.

In the embodiments of the present invention, the pressures of the first chamber and second chamber and the nozzle having an aperture between these chambers are made to satisfy specific conditions to form a supersonic jet region at the second chamber and metal ions and the sample are injected in the vicinity of the expansion part of the supersonic jet. At the expansion part, the sample and the metal ions collide at a high collision frequency, so there are more opportunities for attachment, the vibration, rotation, and translation motions are cooled, and the surplus energy causing disassociation of the attached ions is quickly removed. In an ion attachment mass spectrometry apparatus, the neutral gas and ions attach to each other, but no Coulomb force is created between the two, so the same situation arises as to the formation of gas clusters between gases. Note that in an inductively coupled plasma mass spectrometry apparatus or atmospheric pressure ionization mass spectrometry apparatus for stripping electrons to obtain positive ions, the supersonic jet does not contribute anything at all to the improvement of the efficiency of ionization.

As a specific condition for forming the supersonic jet, it is sufficient to make the Knudsen number not more than 0.01 and make the second chamber have a pressure of not more than 1/10th of the first chamber. Further, to form a more powerful supersonic jet, it is sufficient to make the Knudsen number not more than 0.001, make the first chamber at least atmospheric pressure, and make the second chamber not more than 1000 Pa.

For injecting metal ions and sample gases in the vicinity of the expansion part of the supersonic jet, three methods for injection from (a) the first chamber, (b) the second chamber side, and (c) a hole in the middle of the nozzle are conceivable. Concerning the injection of metal ions, with injection of metal ions from the first chamber, the high pressure is used to control the flow of gas and transport it to the aperture inlet of the nozzle. In injection of metal ions from the second chamber, the electric field is controlled to control the motions of the metal ions and irradiate the aperture outlet of the nozzle with the metal ions. With injection of metal ions from the middle of the hole of the nozzle, the contact with the expansion part is used for direct irradiation or the inside surface of the nozzle is made the emitter. On the other hand, concerning the injection of a sample gas, with injection of a sample gas from the first chamber, in the same way as the prior art, the sample gas is introduced in the first chamber. With injection of a sample gas from the second chamber, the low pressure (facilitates to inject a sample gas) and, when injecting from the middle of the nozzle, the contact with the expansion part is used for direct introduction.

Using the above method, it is possible to raise the transport efficiency of the metal ions to the attachment region. Further, in every case of (a), (b) and (c), it is possible to raise the transport efficiency of the attached ions to the mass spectrometer by making attached ion stream converge to smaller region, having the attachment region located in the second chamber, and aligning well the speed and direction of ions ejected from these as characteristics of the supersonic jet.

In particular, if satisfying $L<0.67\times D\times(P1/P2)^{0.5}$ meaning that there is a Mach disk after the aperture provided in the front of the mass spectrometer, the attached ions strike the mass spectrometer while aligned in direction and speed, so a higher transport efficiency can be realized.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Below, preferred embodiments of the present invention will be explained based on the attached drawings. The configuration, shape, size, and positional relationship explained in the embodiments are shown only schematically to an extent enabling the present invention to be understood and worked. Furthermore, the numerical values and composition (material) of the components are only illustrations. Therefore, the present invention is not limited to the embodiments explained below. Various modifications are possible so long as not exceeding the gist of the technical idea shown in the claims.

Figure 1:
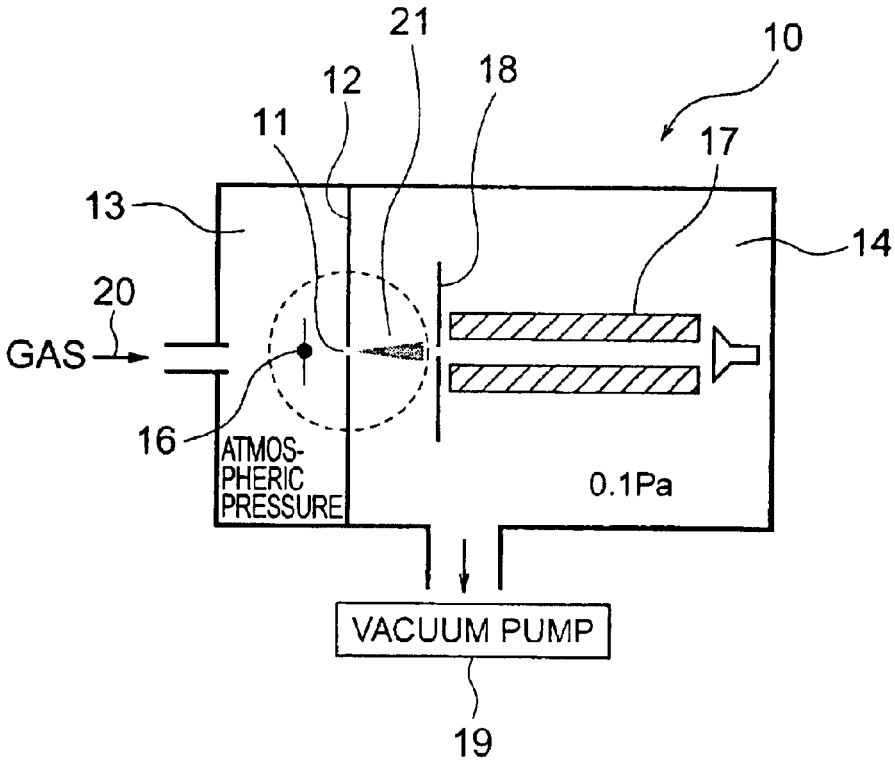
FIG. 1 is a schematic view of the overall configuration of an ion attachment mass spectrometry apparatus according to a first embodiment of the present invention.

A first embodiment of the present invention will be explained with reference to FIG. 1 and FIG. 2. FIG. 1 is a view schematically showing the overall configuration of an ion attachment mass spectrometry apparatus according to the first embodiment, while FIG. 2 is a partial detailed view of the vicinity of the emitter nozzle.

The apparatus container 10 is divided into a first chamber 13 and second chamber 14 sealed by a partition 12 having an aperture 11. The aperture 11 is formed by a nozzle 15. Inside the first chamber 13, an emitter 16 generating positive metal ions is arranged. The emitter 16 is spherically shaped and is heated by a wire-shaped heater passed through its center. Illustration of the configuration of the electric circuit etc. powering the wire-shaped heater of the emitter 16 is omitted. The second chamber 14 is provided with a mass spectrometer 17 for using the electromagnetic force to separate and detect the ions by mass. An aperture 18 is provided at the front surface of the mass spectrometer 17. The second chamber 14 is provided with a vacuum pump 19 for reducing the pressure of the same. Further, the first chamber 13 is provided with a sample gas introduction mechanism (not shown) for introducing a sample gas of a neutral gas 20.

Figure 2:
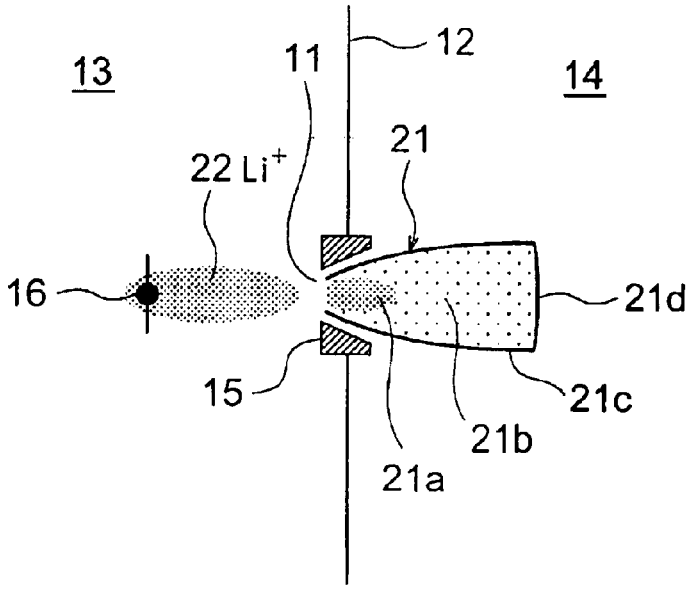
FIG. 2 is a partial detailed view of the vicinity of an emitter nozzle of an ion attachment mass spectrometry apparatus according to the first embodiment.

As shown in FIG. 2, a supersonic jet 21 is formed at the second chamber 14 side of the nozzle 15. The supersonic jet 21 is formed with an expansion part 21*a*, a silent part 21*b*, a barrel shock part 21*c*, and a Mach disk 21*d*.

The pressure P1 of the first chamber 13 is made the atmospheric pressure ($1\times10^5$ Pa), so the length of mean free path $\lambda$ is 0.07 $\mu$m ($7\times10^{-5}$ mm). The diameter D of the circular aperture 11 of the nozzle 15 is made 0.1 mm, so the Knudsen number ($\lambda$/D) becomes $7\times10^{-4}$. The evacuation speed of the vacuum pump 19 is made 1000 liter/sec, so the pressure P2 of the second chamber 14 becomes 0.1 Pa. The distance L from the nozzle 15 to the aperture 18 is made 50 mm. This is shorter than the distance up to the Mach disk 21*c* ($=0.67\times D\times(P1/P2)^{0.5}=67$ mm). According to this condition, the gas blown from the aperture outlet of the nozzle 15 forms a supersonic jet 21 and the silent part 21*b* extends beyond the aperture 18.

The $Li^+$ and other metal ions (region 22) discharged from the emitter 16, riding the flow of gas of the pressure 1000 times as high as in a conventional mass spectrometry apparatus to be transported efficiently to the aperture inlet of the nozzle 15 and injected to the vicinity of the expansion part 21*a* of the region of the supersonic jet 21 present in the vicinity of the outlet of the nozzle 15. Furthermore, the sample gas also passes through the nozzle 15 to be injected in the vicinity of the expansion part 21*a*. At the expansion part 21*a*, the molecules of the sample gas and the metal ions collide with a high collision frequency, so the opportunities for attachment increase, the vibration, rotation, and translation motions are cooled, and the surplus energy causing detachment of the attached ions is quickly removed, so the efficiency of generation of attachment ions is high. Further, the reduced small attachment region is present in the second chamber 14 and the speed and direction of the ions ejected from this region are well aligned, so the transport efficiency of the attached ions to the mass spectrometer 17 becomes higher.

Figure 3:
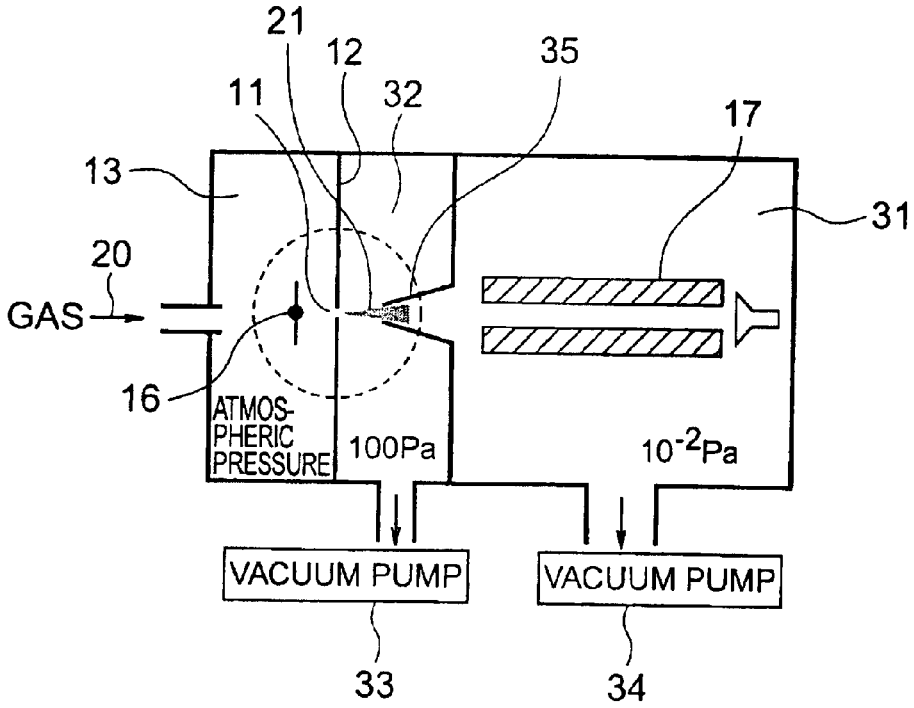
FIG. 3 is a schematic view of the overall configuration of an ion attachment mass spectrometry apparatus according to a second embodiment of the present invention.
Figure 4:
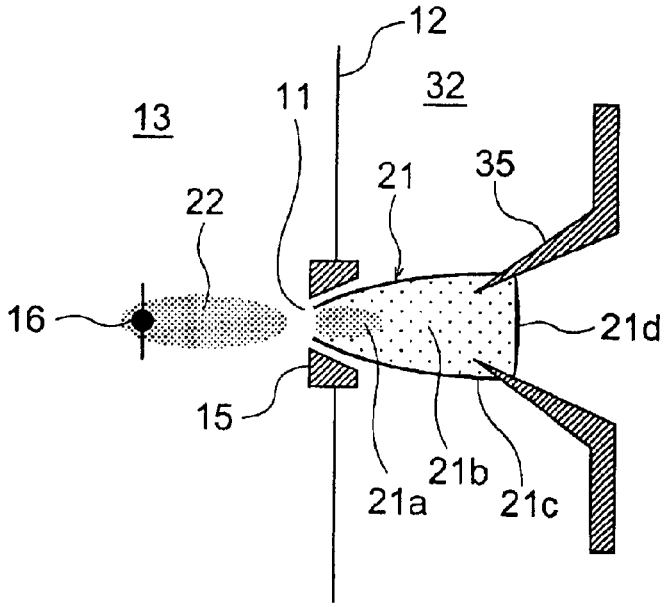
FIG. 4 is a partial detailed view of the vicinity of an emitter nozzle of an ion attachment mass spectrometry apparatus according to the second embodiment.

Next, a second embodiment of the present invention will be explained with reference to FIG. 3 and FIG. 4. FIG. 3 is a view schematically showing the overall configuration of an ion attachment mass spectrometry apparatus according to the second embodiment, while FIG. 4 is a partial detailed view of the vicinity of the emitter nozzle. In these figures, elements which are substantially the same as the elements explained in the first embodiment are assigned the same reference numerals.

The point of difference in configuration from the first embodiment is as follows. The mass spectrometer 17 is provided at the third chamber 31, while the second chamber 32 is formed between the first chamber 13 and third chamber 31. The second chamber 32 is evacuated by a vacuum pump 33. The third chamber 31 is evacuated by a vacuum pump 34. The aperture 35 positioned at the front surface of the mass spectrometer 17 functions also as the partition between the second chamber and third chamber. The shape of the aperture part connecting the second chamber and the third chamber is that of a cone projecting to the second chamber 32 side. The rest of the configuration is the same as the configuration explained in the first embodiment.

In this embodiment, the pressure P1 of the first chamber 13 is made the atmospheric pressure ($1\times10^5$ Pa) and the diameter of the circular aperture 11 of the nozzle 15 is made 1 mm, so the Knudsen number ($\lambda$/D) becomes $7\times10^{-5}$. The evacuation speed of the vacuum pump 33 is made 100 liter/sec, so the pressure P2 of the second chamber 32 becomes 100 Pa. The diameter of the aperture 35 is made 0.3 mm and the evacuation speed of the vacuum pump 34 is made 100 liter/sec, so the pressure of the third chamber 31 becomes $10^{-2}$ Pa. The length of mean free path of the third chamber 31 becomes 700 mm and the ions and gas proceed without colliding with ambient gas. The distance L from the nozzle 15 to the aperture 35 is made 5 mm, but this becomes shorter than the 6.7 mm ($=0.67\times D\times(P1/P2)^{0.5}$) of the distance to the Mach disk. Under this condition, the gas blown out from the aperture outlet of the nozzle 15 forms a supersonic jet 21, and the silent part 21*d* extends up to the aperture 35.

The injection of the metal ions and sample gas to the vicinity of the expansion part 21*a* and the generation of the attached ions are performed in the same way as the first embodiment, so the efficiency of generation of attached ions is high. In the third chamber 31, there is no collision with the ambient gas, so the attached ions are transported to the mass spectrometer 17 with the speed and direction well aligned and the transport efficiency of the attached ions to the mass spectrometer 17 is high. Due to the diameter of the aperture 11 of the nozzle 15 being larger than that of the first embodiment and there being no disturbance of the silent part 21*c* due to the circular cone-shaped aperture 35, the measurement sensitivity becomes higher than the case of the first embodiment.

Figure 5:
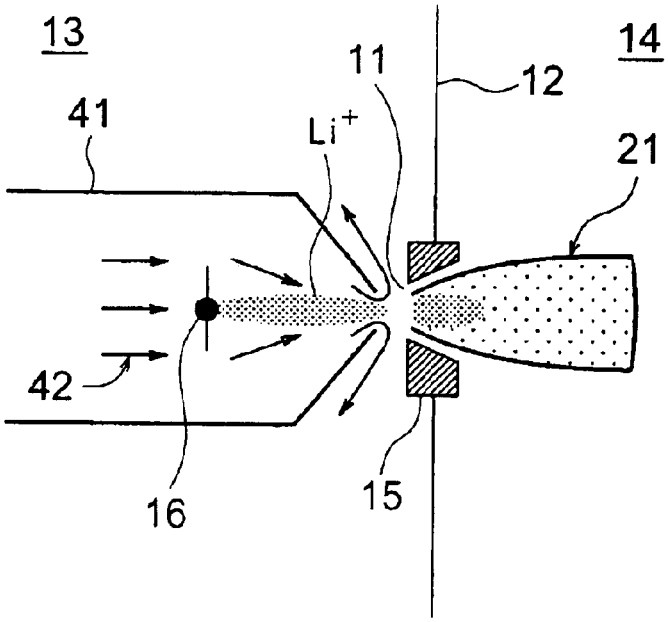
FIG. 5 is a partial detailed view of the vicinity of an emitter nozzle of an ion attachment mass spectrometry apparatus according to the third embodiment.

Next, a third embodiment of the present invention will be explained with reference to FIG. 5. FIG. 5 is a partial detailed view of the vicinity of the emitter nozzle. In this embodiment, the configuration of the portion in the vicinity of the emitter nozzle is changed. The configuration of the present embodiment may be freely combined with the configuration of the first or second embodiment. In this figure, elements which are substantially the same as the elements explained in the above embodiment are assigned the same reference numerals.

In the configuration of the third embodiment, the point of difference from the first embodiment is that the first chamber 13 is provided with a pipe 41 and the flow of gas 42 is controlled. The rest of the configuration is the same as that of the first embodiment. The pipe 41 surrounds the emitter and has one end (left end in the figure) including the sample gas introduction mechanism in its inside and sealed by the wall of the first chamber 13, while the other end (right end in the figure) is formed as a cone and extending up to the vicinity of the aperture inlet of the nozzle 15. In this way, the flow of the gas 42 is controlled so as to be directed to the nozzle inlet. Therefore, the $Li^+$ and other metal ions discharged from the emitter 16 ride the flow of gas of a pressure $1\times10^3$ times higher than that of the conventional apparatus and is efficiently transported from the nozzle inlet.

Figure 6:
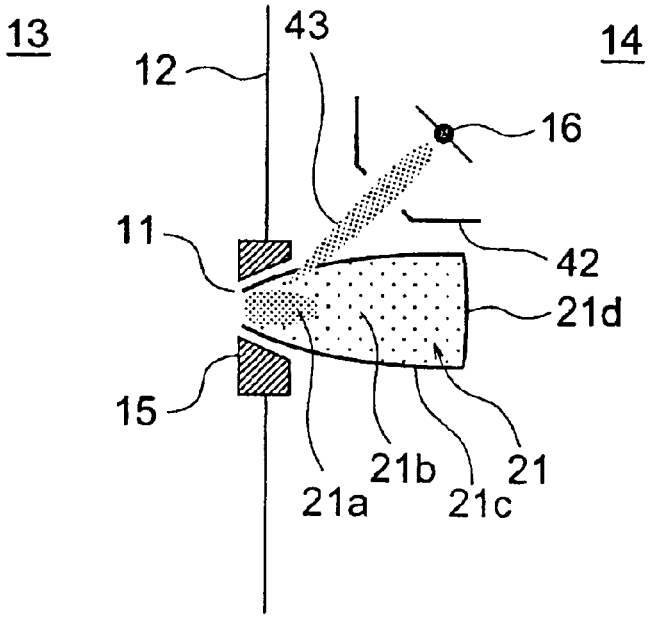
FIG. 6 is a partial detailed view of the vicinity of an emitter nozzle of an ion attachment mass spectrometry apparatus according to the fourth embodiment.

Next, a fourth embodiment of the present invention will be explained with reference to FIG. 6. FIG. 6 is a partial detailed view of the vicinity of the emitter nozzle. In this embodiment, the configuration of the portion in the vicinity of the emitter nozzle is changed. The configuration of the present embodiment may be freely combined with the configuration of the first or second embodiment. In this figure, elements which are substantially the same as the elements explained in the above embodiment are assigned the same reference numerals.

In the configuration of the present embodiment, the point of difference from the first embodiment is that the emitter 16 is provided at the second chamber 14 side. The emitter 16 is provided with a convergence lens 42 at a position away from the flow of the gas. An $Li^+$ beam 43 is given from the emitter 16 toward the aperture outlet of the nozzle 15. The rest of the configuration is the same as in the first embodiment. The pressure of the second chamber 14 is 0.1 Pa, so the length of mean free path becomes 70 mm. Therefore, the $Li^+$ and other metal ions can proceed without colliding with the ambient gas. Therefore, the metal ions composing the beam 43 controlled by the electric field of the convergence lens 42 are irradiated toward the vicinity of the expansion part 21*a* of the supersonic jet 21. The energy of the beam 43 of the metal ions is adjusted by the voltage of the emitter 16.

Because of the existence of a high pressure barrier of a barrel shock 21*c* existing at the side surface of the supersonic jet 21, the gas or ions engaged in thermal motion cannot overcome this. However, if the energy of the beam 43 is increased, the metal ions can penetrate through the barrel shock 21*c* and proceed to the expansion part 21*a*. On the other hand, the pressure of the expansion part 21*a* is considerably higher than the barrel shock 21*c*, so at the expansion part 21*a*, the metal ions rapidly decelerate due to the collision with the gas. Therefore, if making the energy of the beam 43 a suitable value, it is possible to inject metal ions to the vicinity of the expansion part 21*a*. Note that the supersonic jet 21 itself is formed by a neutral gas, so there is no effect of the electric field at all.

In the present embodiment, there is also an effect on the problem of products depositing on the surface of the emitter 16 and ending up reducing the amount of discharge of the metal ions. The concentration of the sample gas contacting the emitter 16 is proportional to the pressure. The pressure in this embodiment is 1/1000 times as high as that in the conventional ion attachment mass spectrometry apparatus and 1/1,000,000 times as high as that in the configuration of the first embodiment. There are the effects that compared with the first embodiment, the transport efficiency of the metal ions to the attachment region becomes higher and the deposition of products on the surface of the emitter 16 is greatly reduced.

Figure 7:
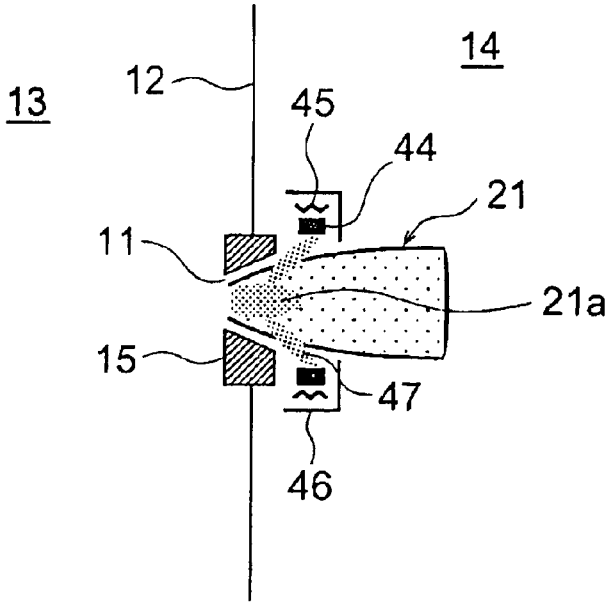
FIG. 7 is a partial detailed view of the vicinity of an emitter nozzle of an ion attachment mass spectrometry apparatus according to the fifth embodiment.

Next, a fifth embodiment of the present invention will be explained with reference to FIG. 7. FIG. 7 is a partial detailed view of the vicinity of the emitter nozzle. This embodiment is predicated on the configuration of the fourth embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

In the configuration of the present embodiment, the point of difference from the fourth embodiment is that the emitter 44 is ring shaped. The ring-shaped emitter 44 is arranged in a coaxial positional relationship around the aperture outlet of the nozzle 15. A heater 45 is arranged around the emitter 44 and a repeller 46 is provided at the outside of that. The rest of the configuration is the same as the fourth embodiment.

The ring-shaped emitter 44 is heated by the heater 45 at the outside whereby $Li^+$ and other metal ions are emitted. The metal ions are formed into a ring-shaped beam 47 by the electric field of the ring-shaped repeller 46 and injected in the vicinity of the expansion part 21*a*. Compared with the fourth embodiment, it is possible to inject a large amount of metal ions and improve the measurement sensitivity further.

Figure 8:
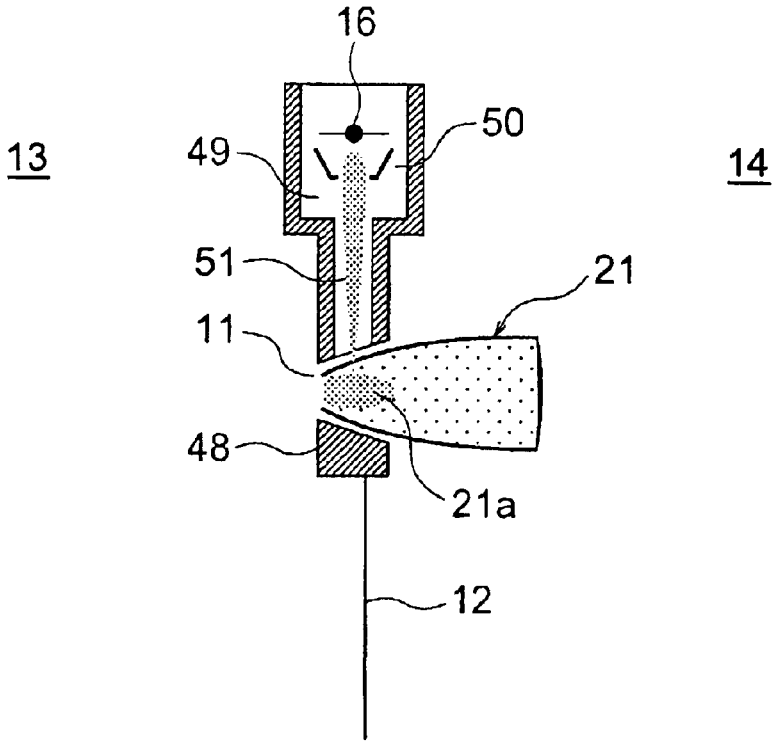
FIG. 8 is a partial detailed view of the vicinity of an emitter nozzle of an ion attachment mass spectrometry apparatus according to a sixth embodiment.

Next, a sixth embodiment of the present invention will be explained with reference to FIG. 8. FIG. 8 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

In the configuration of the present embodiment, the points of difference from the first embodiment are that the emitter 16 divides the chamber into the first chamber 13 and second chamber 14 and is provided in a chamber 49 communicating with the inside of the nozzle 48. Part of the partition 12 is used whereby a structure providing a chamber 49 and nozzle 48 is added. In the chamber 49, a conveyance lens 50 is provided at the emitter 16. The rest of the configuration is the same as the first embodiment. According to this embodiment, the hole in the middle connected to the aperture 11 of the nozzle 48 is in contact with the expansion part 21*a*, so it is possible to directly inject the $Li^+$ or other metal ion beam 51. Compared with the fourth embodiment, it is possible to stably inject the metal ions.

Figure 9:
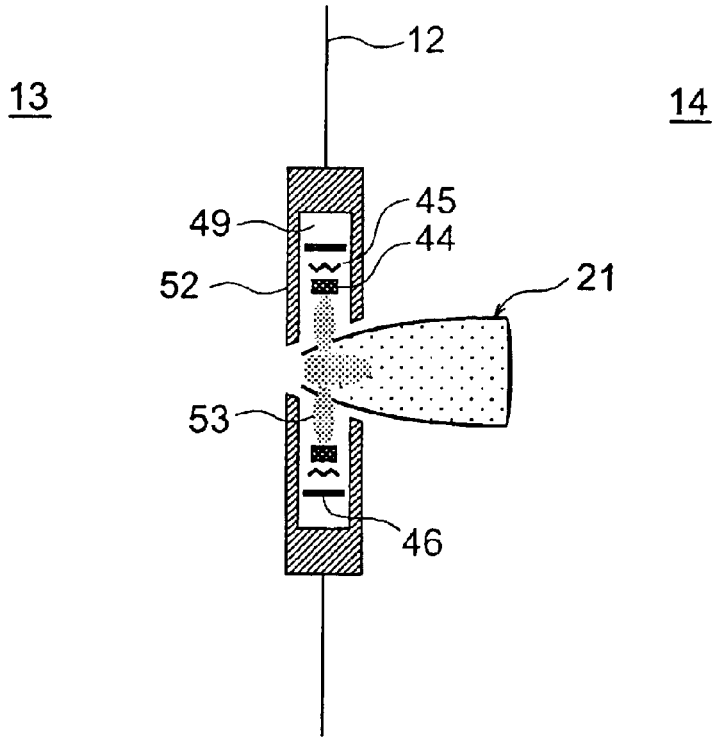
FIG. 9 is a partial detailed view of the vicinity of an emitter nozzle of an ion attachment mass spectrometry apparatus according to a seventh embodiment.

Next, a seventh embodiment of the present invention will be explained with reference to FIG. 9. FIG. 9 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

In this embodiment, the point of difference from the sixth embodiment is that the emitter 44 is formed in a ring shape as in the fifth embodiment and the ring-shaped heater 45 and repeller 46 are arranged around it. The chamber 49 for forming the space for arranging the emitter 44, heater 45, and repeller 46 is formed by a container 52 having a nozzle portion at the center. Reference numeral 53 is a ring-shaped $Li^+$ beam. According to the present embodiment, it is possible to inject metal ions stably and in large quantities.

Figure 10:
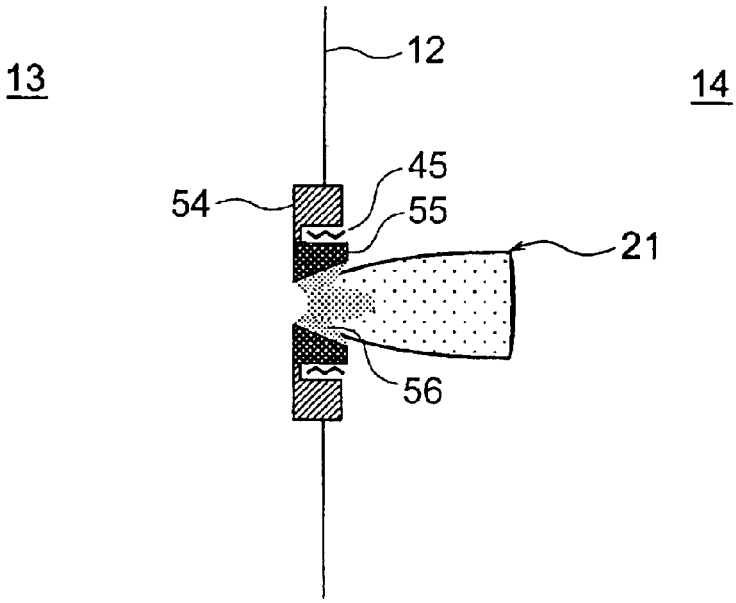
FIG. 10 is a partial detailed view of the vicinity of an emitter nozzle of an ion attachment mass spectrometry apparatus according to an eighth embodiment.

Next, an eighth embodiment of the present invention will be explained with reference to FIG. 10. FIG. 10 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

The present embodiment is substantially a modification of the fifth embodiment. The points of difference from the fifth embodiment are that part of the nozzle 54 forms the emitter 55 and that metal ions 56 are generated from all of the inside wall of the emitter 55 forming the nozzle. According to the present embodiment, the structure becomes simple and the metal ions can be injected stably in a large quantity.

Figure 11:
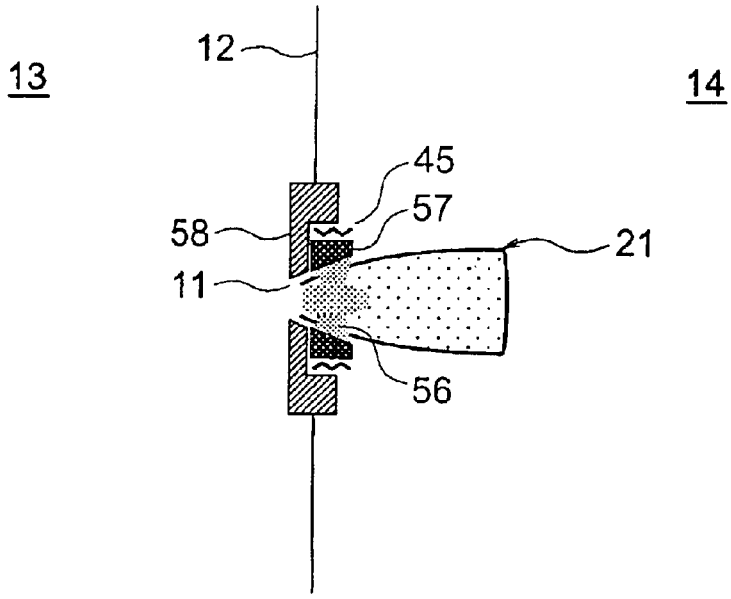
FIG. 11 is a partial detailed view of the vicinity of an emitter nozzle of an ion attachment mass spectrometry apparatus according to a ninth embodiment.

Next, a ninth embodiment of the present invention will be explained with reference to FIG. 11. FIG. 11 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

The present embodiment is a modification of the eighth embodiment. This embodiment as well, like the eighth embodiment, is provided with a nozzle-shaped emitter 57. The point of difference of the eighth embodiment is provided with a nozzle member 58 having an aperture 11 and is provided with a nozzle-shaped emitter 57 at the outlet side. Metal ions are generated from part of the inside wall forming the nozzle. Compared with the eighth embodiment, there is no need to form a fine hole by an emitter.

Figure 12:
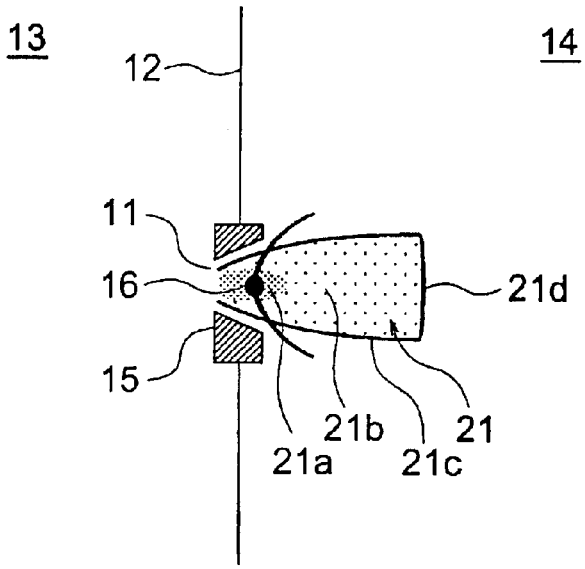
FIG. 12 is a partial detailed view of the vicinity of an emitter nozzle of an ion attachment mass spectrometry apparatus according to a 10th embodiment.

Next, a 10th embodiment of the present invention will be explained with reference to FIG. 12. FIG. 12 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

The present embodiment is a modification of a fourth embodiment explained in FIG. 6. In the present embodiment as well, like with the fourth embodiment, there is provided an emitter 16 of a spherical shape and heated by a wire-shaped heater passing through its center. The point of difference from the fourth embodiment is that the emitter 16 is positioned inside the supersonic jet 21. The presence of the emitter 16 disturbs the flow of the gas at the supersonic jet 21. Despite this defect, it is possible to inject metal ions reliably by a simple structure. Note that the present embodiment can be thought to be a modification of the ninth embodiment of FIG. 11 wherein the emitter is spherically shaped and moved into the supersonic jet 21

Figure 13:
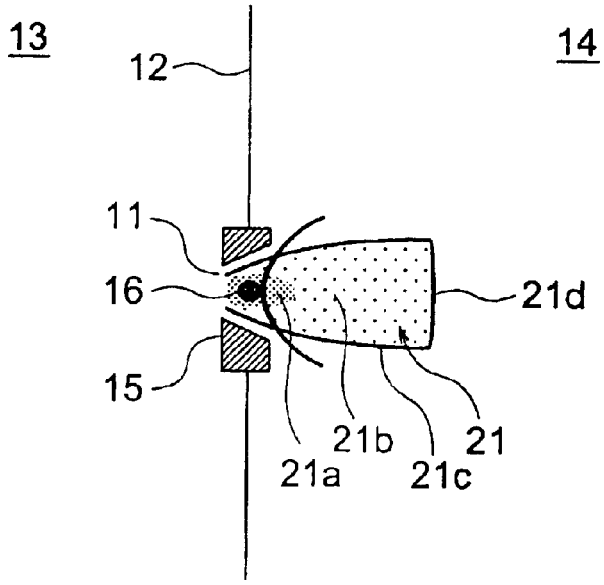
FIG. 13 is a partial detailed view of the vicinity of an emitter nozzle of an ion attachment mass spectrometry apparatus according to an 11th embodiment.

FIG. 13 shows an 11th embodiment. This embodiment is a modification of the 10th embodiment. In this embodiment, unlike the 10th embodiment, the emitter 16 is held on the surface of a wire-shaped heater. The part of the heater holding the emitter is shaped not to disturb the gas as much as possible and to be able to efficiently generate metal ions. By this configuration, the flow of gas at the supersonic jet 21 is kept to a minimum and the metal ions are reliably injected.

Figure 14:
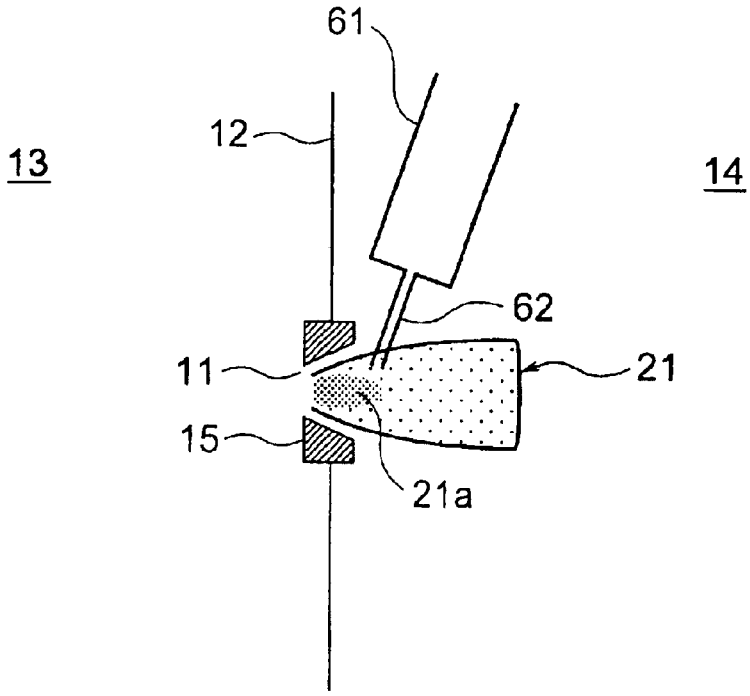
FIG. 14 is a partial detailed view of the vicinity of an emitter nozzle of an ion attachment mass spectrometry apparatus according to a 12th embodiment.

Next, a 12th embodiment of the present invention will be explained with reference to FIG. 14. FIG. 14 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

The points of difference from the first embodiment are that a base gas introduction mechanism (not shown) is connected to the first chamber 13 and the sample gas introduction mechanism 61 is connected to the second chamber 14 and that a fine tube 62 is attached to the sample gas introduction mechanism 61 and the tip of the fine tube 62 is extended up to the region of the supersonic jet 21. $N_2$ is used as the base gas.

In the present embodiment, there is an effect on the problem of the pressure of the measured gas having to be made higher than the pressure of the first chamber 13. The expansion part 21*a* of the region of the supersonic jet 21 is a pressure close to the first chamber 13 in the vicinity of the nozzle inlet, but the pressure rapidly decreases from there and becomes a pressure close to the second chamber 14 near the end. Therefore, by selecting the location of the tip of the fine tube 62, the pressure of the sample gas required can be reduced from the pressure of the first chamber 13. Furthermore, it is known that the effect of the supersonic jet 21 becomes higher by making the pressure of the first chamber 13 higher than the atmospheric pressure. In the present embodiment, since only base gas is introduced into the first chamber 13, it becomes easy to raise the pressure of the first chamber 13.

Figure 15:
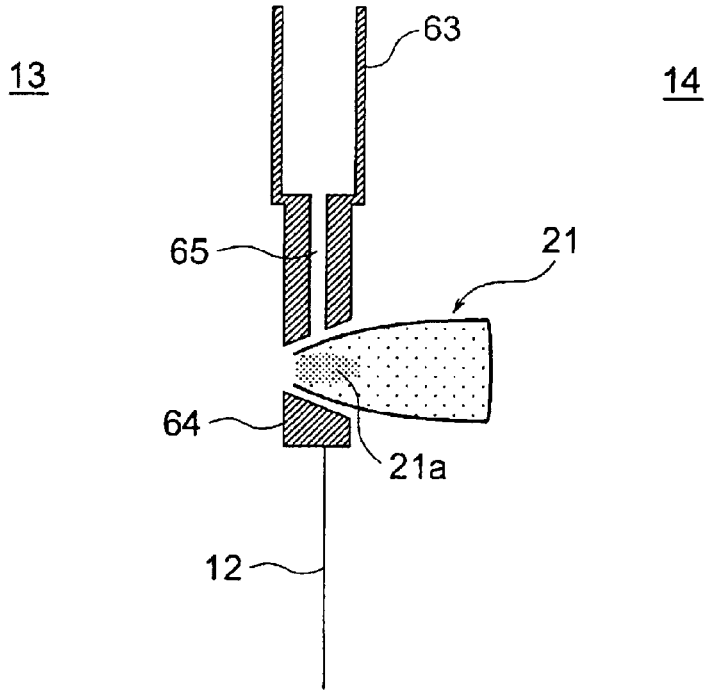
FIG. 15 is a partial detailed view of the vicinity of an emitter nozzle of an ion attachment mass spectrometry apparatus according to a 13th embodiment.

Next, a 13th embodiment of the present invention will be explained with reference to FIG. 15. FIG. 15 is a partial detailed view of the vicinity of the emitter nozzle. This embodiment is predicated on the configuration of the first embodiment and is changed in the configuration of the portion in the vicinity of the emitter nozzle. The configuration of the present embodiment may be freely combined with the configuration of the first or second embodiment. In this figure, elements which are substantially the same as the elements explained in the above embodiment are assigned the same reference numerals.

The present embodiment is a modification of the 10th embodiment. In the present embodiment, the point of difference from the 10th embodiment is that the sample introduction mechanism 63 separate the chamber into a first chamber 13 and second chamber 14 and is provided in a chamber 65 communicating with the inside of the nozzle 64. The hole in the middle of the nozzle 64 contacts the expansion part 21*a*, so it is possible to directly inject the sample. Compared with the 10th embodiment, there is less disturbance of the supersonic jet 21.

Figure 16:
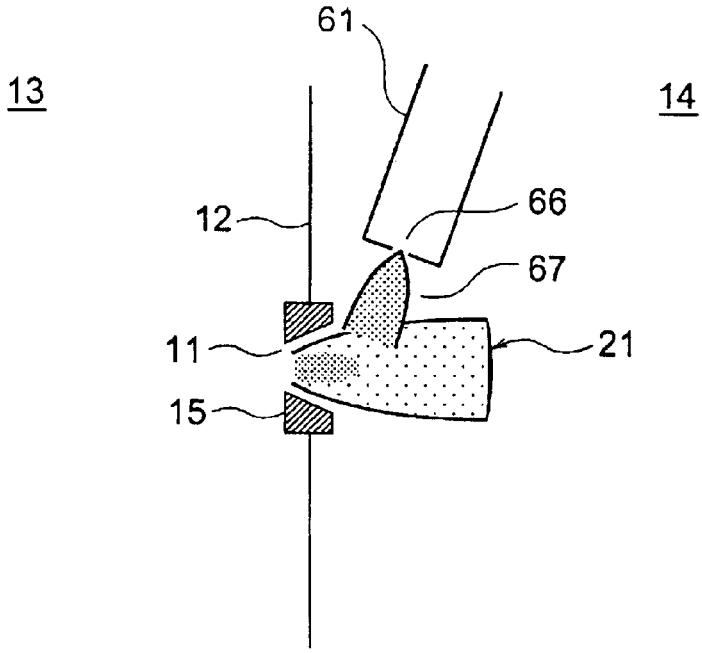
FIG. 16 is a partial detailed view of the vicinity of an emitter nozzle of an ion attachment mass spectrometry apparatus according to a 14th embodiment.
Figure 17:
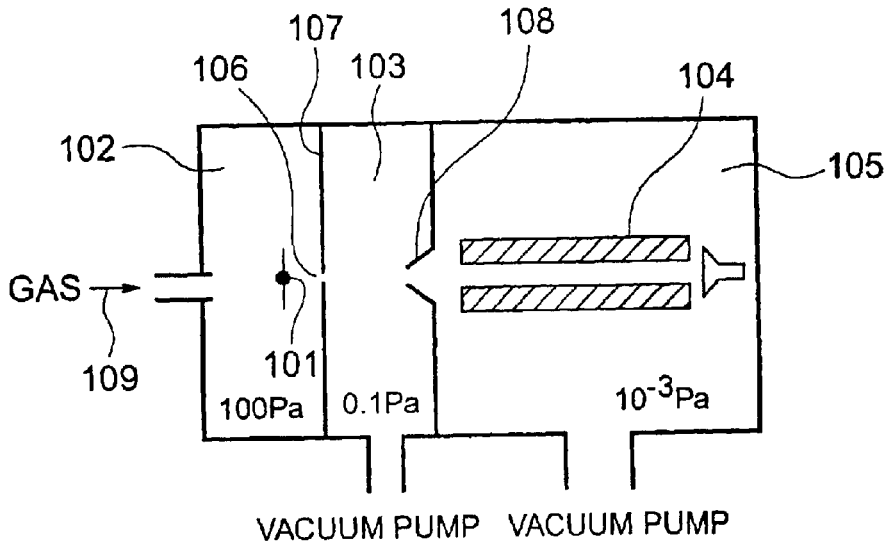
FIG. 17 RELATED ART
FIG. 17 is a schematic view of the overall configuration of a conventional ion attachment mass spectrometry apparatus.
Figure 18:
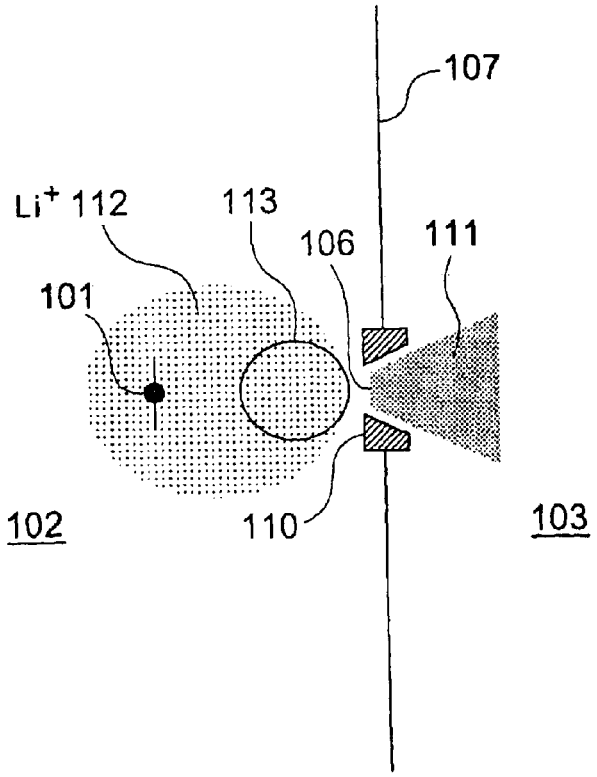
FIG. 18 RELATED ART
FIG. 18 is a partial detailed view of the vicinity of an emitter nozzle of a conventional ion attachment mass spectrometry apparatus according to the first embodiment.

Next, a 14th embodiment of the present invention will be explained with reference to FIG. 16. FIG. 16 is a detailed view of the part near the emitter nozzle. The present embodiment is predicated on the configuration of the first embodiment. The configuration of the part near the emitter nozzle is changed. The configuration of the present embodiment may be combined with the configuration of the first or second embodiment. In this figure, elements which are substantially the same as the elements explained in the above embodiment are assigned the same reference numerals.

The present embodiment is a modification of the 10th embodiment. In the present embodiment, the point of difference with the 10th embodiment is that a second nozzle 66 is attached to the tip of the sample introduction mechanism 61 and a supersonic jet 67 of the sample gas is formed. The silent part of the supersonic jet 67 of the sample is overlapped with the barrel shock of the supersonic jet 21 from the first chamber 13. The enegy of the sample gas at the silent part of the supersonic jet 67 reaches as much as 3 eV or 100 times the atmospheric gas, so the sample gas can override the barrel shock of the supersonic jet 21. According to the present embodiment, compared with the 10th embodiment, there is less disturbance of the supersonic jet 21.

Above, the present invention was explained using several embodiments, but the present invention is not limited to these embodiments. As the shape of the nozzle, a Laval shape with a narrow tip and a broad end was explained, but it may also conversely be a sonic shape with a thick tip and a narrow end. It may also be an aperture type comprising a thin plate with a hole. The emitter was explained with reference to a spherical shape through which a wire-shaped heater was passed and a ring shape heated by an external heater, but a type which provides an emitter at the tip of a cylinder and a heater at the other end, a type coating an emitting material on a ring-shaped heater, etc. may also be used. As the metal ions, other than $Li^+$, $Na^+$, $K^+$, $Rb^+$, $Cs^+$, $Al^+$, $Ga^+$, $In^+$, etc. may also be used. The mass spectrometer was explained as a quadrupole mass spectrometer, but a magnetic field sector type, time of flight type, ion cyclotron type, etc. may also be used. Further, the base gas is not limited to $N_2$, He, Ne, Ar, Kr, Xe, or another rare gas may also be used.

Further, the aperture was made a flat one in the first embodiment and made a conical shape in the second embodiment, but the invention is not limited to these. They may also be reversed. From the third embodiment to the 14th embodiment, the explanation was given based on the first embodiment and showing the changed locations, but it is also possible to use the second embodiment as a basis. Any of the third embodiment to the 11th embodiment relating to the injection of metal ions and the 12th embodiment to 14 embodiment relating to sample injection may also be used in combination.

Each of the embodiments includes a controller, not shown. The controller is used to control the various operations of each of the elements of each embodiment, including, for example, the sample or neutral gas introduction mechanism, the vacuum pumps, the emitter, and the mass spectrometer. The controller can be used to control, among other elements, the relative pressures in each chamber. As a result, the Knudsen number can be controlled, in part, by the controller. The controller may be one or more components. Based on the foregoing details, a controller can be designed according to known principles. Accordingly, further details of the controller are omitted.

According to the present invention, it is possible to provide an ion attachment mass spectrometry apparatus that improves the transport efficiency of metal ions to the attachment region, the attachment efficiency of the metal ions and sample gas, and the transport efficiency of ions attached with the metal ions, and that can analyze the mass of the sample at a high sensitivity without disassociation of sample molecules. Further, it is possible to provide an ionization apparatus or ionization method using ion attachment which attaches metal ions to gas molecules to improve the transport efficiency of metal ions to the attachment region and the attachment efficiency of the metal ions and gas.

The present disclosure relates to subject matter contained in Japanese Patent Application No. 2000-401483, filed on Jul. 2, 2002, the disclosure of which is expressly incorporated herein by reference in its entirety.

What is claimed is:

1. An ion attachment mass spectrometry apparatus, comprising:

a first chamber and a second chamber;

a partition separating the first chamber and the second chamber, the partition having an aperture;

a sample gas introduction mechanism for introducing a sample gas having molecules into the first chamber;

an emitter for generating positive metal ions to attach to the molecules of said sample gas to obtain positive ions;

a mass spectrometer for analyzing a mass of said sample gas attached with said metal ions;

a vacuum pump for reducing the pressure of at least said second chamber; and a controller for controlling the apparatus so that a supersonic jet region is formed in said second chamber by making the Knudsen number $\lambda/D$ (where $\lambda$ is length of mean free path of the gas in the first chamber and D is the diameter of said aperture) of said aperture not more than 0.01, for making the pressure of said second chamber not more than 1/10th of that of said first chamber, for making the gas of said sample of said first chamber be blown out from said aperture to said second chamber, and for injecting the gas of said sample gas and said metal ions into said supersonic jet region to make said metal ions attach to the molecules of said sample gas at said supersonic jet region.

2. The ion attachment mass spectrometry apparatus as set forth in claim 1, wherein the Knudsen number is not more than 0.001, a pressure in the first chamber is at least 1×105 Pa, and a second chamber is not more than 1×103 Pa.

3. The ion attachment mass spectrometry apparatus as set forth in claim 2, wherein a relationship between a pressure of said first chamber of P1, a pressure of said second chamber of P2, and a distance L from said aperture to a second aperture arranged in front of said mass spectrometer is made $L<0.67\times D\times(P1/P2)^{0.5}$ so as to position a Mach disk of said supersonic jet behind said second aperture.

4. The ion attachment mass spectrometry apparatus as set forth in claim 2, wherein the emitter is provided at said first chamber, and the controller controls the flow of gas in said first chamber so that the metal ions generated from said emitter are transported to the vicinity of the aperture inlet of said first chamber and are injected to said supersonic jet region.

5. The ion attachment mass spectrometry apparatus as set forth in claim 1, wherein a relationship between a pressure of said first chamber of P1, a pressure of said second chamber of P2, and a distance L from said aperture to a second aperture arranged in front of said mass spectrometer is made $L<0.67\times D\times(P1/P2)^{0.5}$ so as to position a Mach disk of said supersonic jet behind said second aperture.

6. The ion attachment mass spectrometry apparatus as set forth in claim 1, wherein the emitter is provided at said first chamber, and the controller controls the flow of gas in said first chamber so that the metal ions generated from said emitter are transported to the vicinity of the aperture inlet of said first chamber and are injected to said supersonic jet region.

7. An ionization apparatus, comprising:

a first chamber and a second chamber;

a partition separating the first chamber and the second chamber, the partition having an aperture;

a sample gas introduction mechanism for introducing a neutral gas having molecules into the first chamber;

an emitter provided in the first chamber for generating positive metal ions to attach to the molecules of said sample gas to obtain positive ions;

a vacuum pump for reducing the pressure of at least said second chamber; and a controller for controlling the apparatus so that a supersonic jet region is formed in said second chamber by making the Knudsen number λ/D (where λ is length of mean free path of the gas in the first chamber and D is the diameter of said aperture) of said aperture not more than 0.01, for making the pressure of said second chamber not more than 1/10th of that of said first chamber, for making the gas of said first chamber be blown out from said aperture to said second chamber, and for injecting the gas and said metal ions into said supersonic jet region and to make said metal ions attach to the molecules of said gas at said supersonic jet region.

8. A method for ionization by making metal ions attach to neutral gas molecules, said ionization method comprising:

introducing gas to a first of two chambers separated by a partition provided with an aperture and while evacuating the other of said chambers, making the Knudsen number (λ/D, where λ is length of mean free path in the first chamber and D is the diameter of the aperture) of said aperture not more than 0.01 and giving a pressure difference of a least one order of magnitude in terms of the Pa value between said two chambers so as thereby to form a supersonic jet region in the vicinity of said aperture at the other chamber side, and injecting said metal ions into said supersonic jet region for ionization.

* * * * *